US005670979A

United States Patent [19]

Huq et al.

[11] Patent Number: 5,670,979

[45] Date of Patent: Sep. 23, 1997

[54] DATA LINE DRIVERS WITH COMMON REFERENCE RAMP DISPLAY

[75] Inventors: Ruquiya Ismat Ara Huq, Plainesboro; Dora Plus, S. Bound Brook, both of N.J.

[73] Assignee: Thomson Consumer Electronics, S.A., Courbevoie, France

[21] Appl. No.: 760,680

[22] Filed: Dec. 4, 1996

Related U.S. Application Data

[63] Continuation of Ser. No. 399,009, Mar. 6, 1995, abandoned.

[51] Int. Cl.[6] ..... G09G 3/36

[52] U.S. Cl. ..... 345/100; 345/92

[58] Field of Search ..... 345/87, 89, 90, 345/92, 95, 98, 99, 100, 200, 204; 349/39, 41, 42; 377/64, 70, 74, 79

[56] References Cited

U.S. PATENT DOCUMENTS

| | | | |
|---|---|---|---|
| 3,676,702 | 7/1972 | McGrogan, Jr. | 307/235 |
| 4,393,380 | 7/1983 | Hosokawa . | |
| 4,429,305 | 1/1984 | Hosokawa et al. | 340/784 |
| 4,532,438 | 7/1985 | Reiner | 307/362 |
| 4,742,346 | 5/1988 | Gillette et al. | 340/793 |
| 4,766,430 | 8/1988 | Gillette et al. | 340/793 |
| 4,963,860 | 10/1990 | Stewart | 340/719 |
| 5,017,914 | 5/1991 | Uchida et al. | 340/784 |
| 5,113,134 | 5/1992 | Plus et al. | 324/158 |
| 5,170,155 | 12/1992 | Plus et al. | 340/784 |
| 5,222,082 | 6/1993 | Plus | 377/79 |
| 5,266,936 | 11/1993 | Saitoh | 345/98 |
| 5,317,401 | 5/1994 | Dupont et al. | 345/98 |
| 5,426,447 | 6/1995 | Lee | 345/94 |

*Primary Examiner*—Richard Hjerpe
*Assistant Examiner*—Chanh Nguyen
*Attorney, Agent, or Firm*—Joseph S. Tripoli; Joseph J. Laks; Sammy S. Henig

[57] ABSTRACT

A video display driver applies a video signal to column electrodes of a liquid crystal display. The display driver includes a reference ramp generator and column data line drivers. Each data line driver includes a switching arrangement coupled to a first capacitance for storing a portion of the video signal in the first capacitance. A first terminal of the first capacitance is coupled to the reference ramp generator for combining a reference ramp signal with the stored video signal and for applying the combined signal to an input of a comparator. The comparator controls a transistor that couples a data ramp signal to a given column of the pixels. The reference ramp generator is coupled to the input of the comparator in a non-switched manner such that no switching transistor is interposed in a signal path between the reference ramp generator and the input of the comparator.

12 Claims, 3 Drawing Sheets

PRE-DCTRL
DCTRL(1)
DCTRL(i)
DCTRL(24)
20V
0
9μs
t5a
11μs
23μs
23.9μs
20V/28V
PRE_AUTOZ
5μs
AUTOZERO
DXFER
12V
REF_RAMP
t3
8μs
500
20μs
t4
t9
8.8V/16.8V
DATA_RAMP
1V/9V
VIAD
17μs
10μs
t8
t10
t6
AZ
t0
t1
t2
4μs
t19
t20
32μs

DATA LINE DRIVERS WITH COMMON REFERENCE RAMP DISPLAY

This is a continuation of application Ser. No. 399,009, filed Mar. 6, 1995, now abandoned.

This invention relates generally to drive circuits for display devices and particularly to a system for applying brightness signals to pixels of a display device, such as a liquid crystal display (LCD).

Display devices, such as liquid crystal displays, are composed of a matrix or an array of pixels arranged horizontally in rows and vertically in columns. The video information to be displayed is applied as brightness (gray scale) signals to data lines which are individually associated with each column of pixels. The row of pixels are sequentially scanned and the capacitances of the pixels within the activated row are charged to the various brightness levels in accordance with the levels of the brightness signals applied to the individual columns.

In an active matrix display each pixel element includes a switching device which applies the video signal to the pixel. Typically, the switching device is a thin film transistor (TFT), which receives the brightness information from solid state circuitry. Because both the TFT's and the circuitry are composed of solid state devices it is preferable to simultaneously fabricate the TFT's and the drive circuitry utilizing either amorphous silicon or polysilicon technology.

Liquid crystal displays are composed of a liquid crystal material which is sandwiched between two substrates. At least one, and typically both of the substrates, is transparent to light and the surfaces of the substrates which are adjacent to the liquid crystal material support patterns of transparent conductive electrodes arranged in a pattern to form the individual pixel elements. It may be desirable to fabricate the drive circuitry on the substrates and around the perimeter of the display together with the TFT's.

Amorphous silicon has been the preferable technology for fabricating liquid crystal displays because this material can be fabricated at low temperatures. Low fabrication temperature is important because it permits the use of standard, readily available and inexpensive substrate materials. However, the use of amorphous silicon thin film transistors (a-Si TFTs) in integrated peripheral pixel drivers has been limited because of, low mobility, threshold voltage drift and the availability of only N-MOS enhancement transistors.

U.S. Pat. No. 5,170,155 in the names of Plus et al., entitled "System for Applying Brightness Signals To A Display Device And Comparator Therefore", describes a data line or column driver of an LCD. The data line driver of Plus et al., operates as a chopped ramp amplifier and utilizes TFTs. In the data line driver of Plus et al., an analog signal containing picture information is sampled and stored in an input sampling capacitor of the driver. A reference ramp produced in a reference ramp generator is applied to the input capacitor of the driver via a TFT switch.

It may be desirable to apply the reference ramp in common to each input capacitor without interposing a TFT switch between the reference ramp generator and the input capacitor. Advantageously, by eliminating such TFT switch, the data line driver is less susceptible to threshold voltage drift variations.

A data line driver, embodying an aspect of the invention, for developing a signal containing picture information in pixels of a display device that are arranged in columns includes a first transistor and a first capacitance coupled to the first transistor to form a comparator. A first switching arrangement is coupled to the first capacitance for storing a charge in the first capacitance that automatically adjusts a triggering level of the comparator. A reference ramp generator generates a reference ramp signal. A second capacitance couples the reference ramp signal to an input terminal of the capacitor. A second switching arrangement is coupled to the second capacitance for storing a video signal in the second capacitance. A second transistor is responsive to an output signal of the comparator for applying the data ramp signal to a data line during a period of the data ramp signal controlled by a signal that is developed at the input terminal of the comparator.

Figure 1:
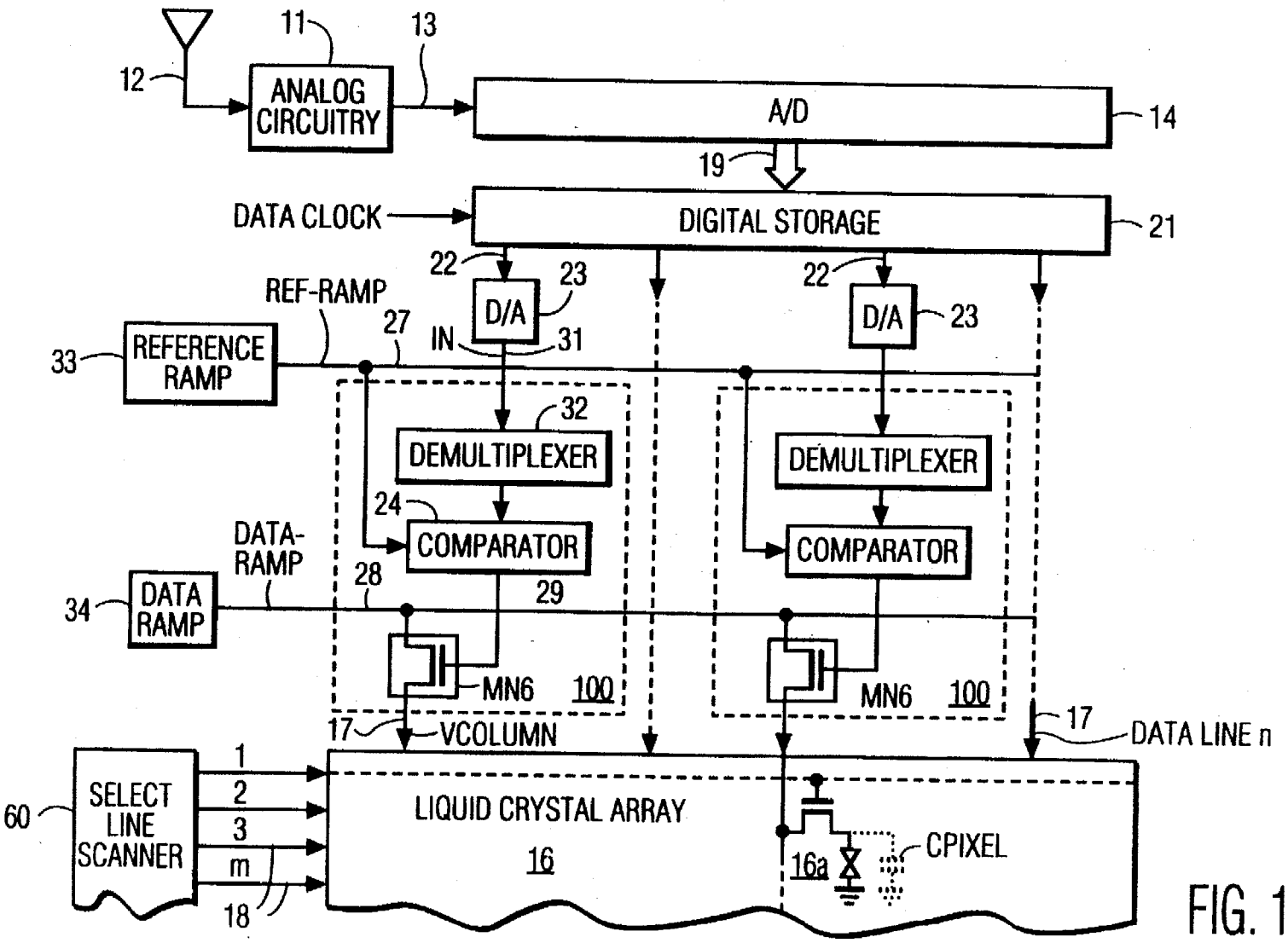
FIG. 1 illustrates a block diagram of a liquid crystal display arrangement that includes demultiplexer and data line drivers, embodying an aspect of the invention.

In FIG. 1, that includes multiplexer and data line drivers 100, embodying an aspect of the invention, an analog circuitry 11 receives a video signal representative of picture information to be displayed from, for example, an antenna 12. The analog circuitry 11 provides a video signal on a line 13 as an input signal to an analog-to-digital converter (A/D) 14.

The television signal from the analog circuitry 11 is to be displayed on a liquid crystal array 16 which is composed of a large number of pixel elements, such as a liquid crystal cell 16*a*, arranged horizontally in m=560 rows and vertically in n=960 columns. Liquid crystal array 16 includes n=960 columns of data lines 17, one for each of the vertical columns of liquid crystal cells 16*a*, and m=560 select lines 18, one for each of the horizontal rows of liquid crystal cells 16*a*.

A/D converter 14 includes an output bus bar 19 to provide brightness levels, or gray scale codes, to a memory 21 having 40 groups of output lines 22. Each group of output lines 22 of memory 21 applies the stored digital information to a corresponding digital-to-analog (D/A) converter 23. There are 40 D/A converters 23 that correspond to the 40 groups of lines 22, respectively. An output signal IN of a given D/A converter 23 is coupled via a corresponding line 31 to corresponding multiplexer and data line driver 100 that drives corresponding data line 17. A select line scanner 60 produces row select signals in lines 18 for selecting, in a conventional manner, a given row of array 16. The voltages developed in 960 data lines 17 are applied during a 32 microsecond line time, to pixels 16*a* of the selected row.

A given demultiplexer and data line driver 100 uses chopped ramp amplifiers, not shown in detail in FIG. 1, with a low input capacitance that is, for example, smaller than 1 pf to store corresponding signal IN and to transfer stored input signal IN to corresponding data line 17. Each data line 17 is applied to 560 rows of pixel cells 16*a* that form a capacitance load of, for example, 20 pf.

Figure 2:
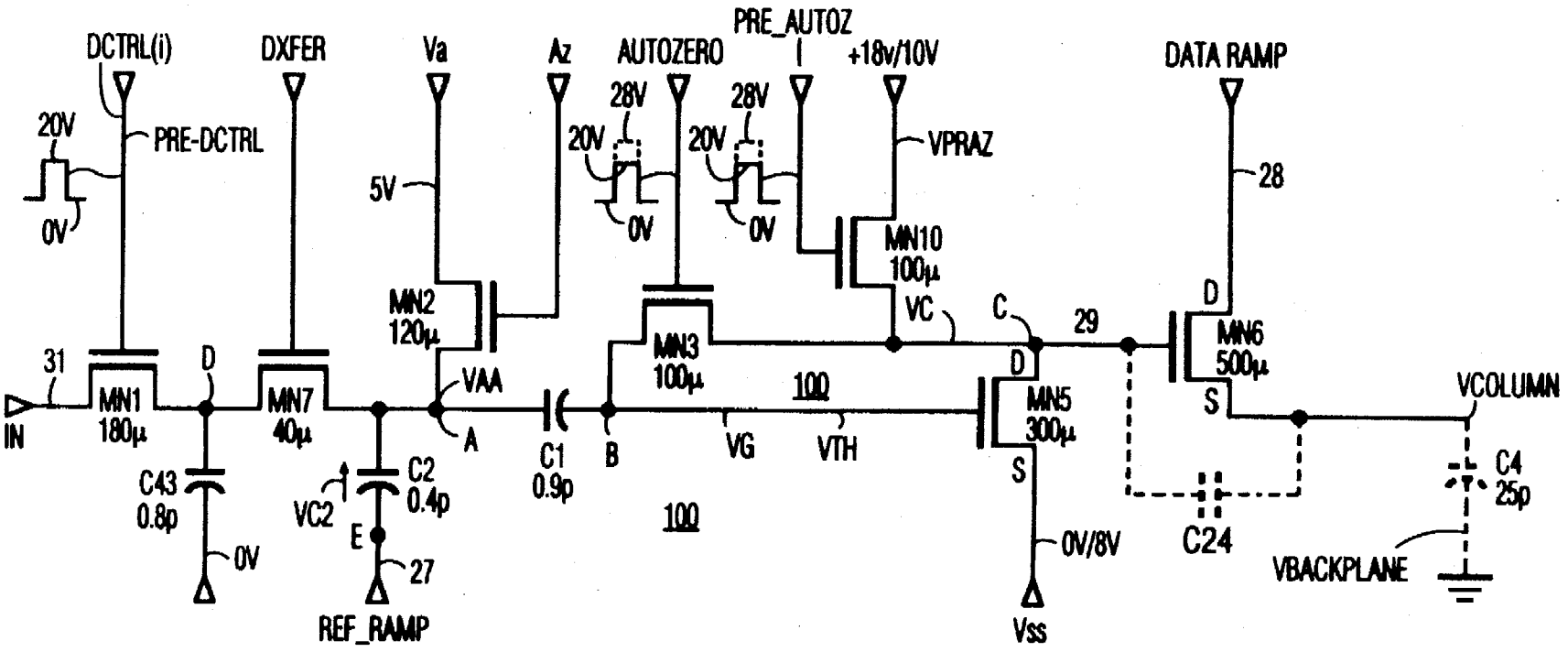
FIG. 2 illustrates the demultiplexer and data line driver of FIG. 1 in more detail.

FIG. 2 illustrates in detail a given one of demultiplexer and data line drivers 100. FIGS. 3*a*–3*g* illustrate waveforms useful for explaining the operation of the circuit of FIG. 2. Similar symbols and numerals in FIGS. 1, 2 and 3*a*–3*g* indicate similar items or functions. All the transistors of demultiplexer and line driver 100 of FIG. 2 are TFT's of the N-MOS type. Therefore, advantageously, they can be formed together with array 16 of FIG. 1 as one integrated circuit.

Figures 3A, 3B, 3C, 3D, 3E, 3F, 3G:
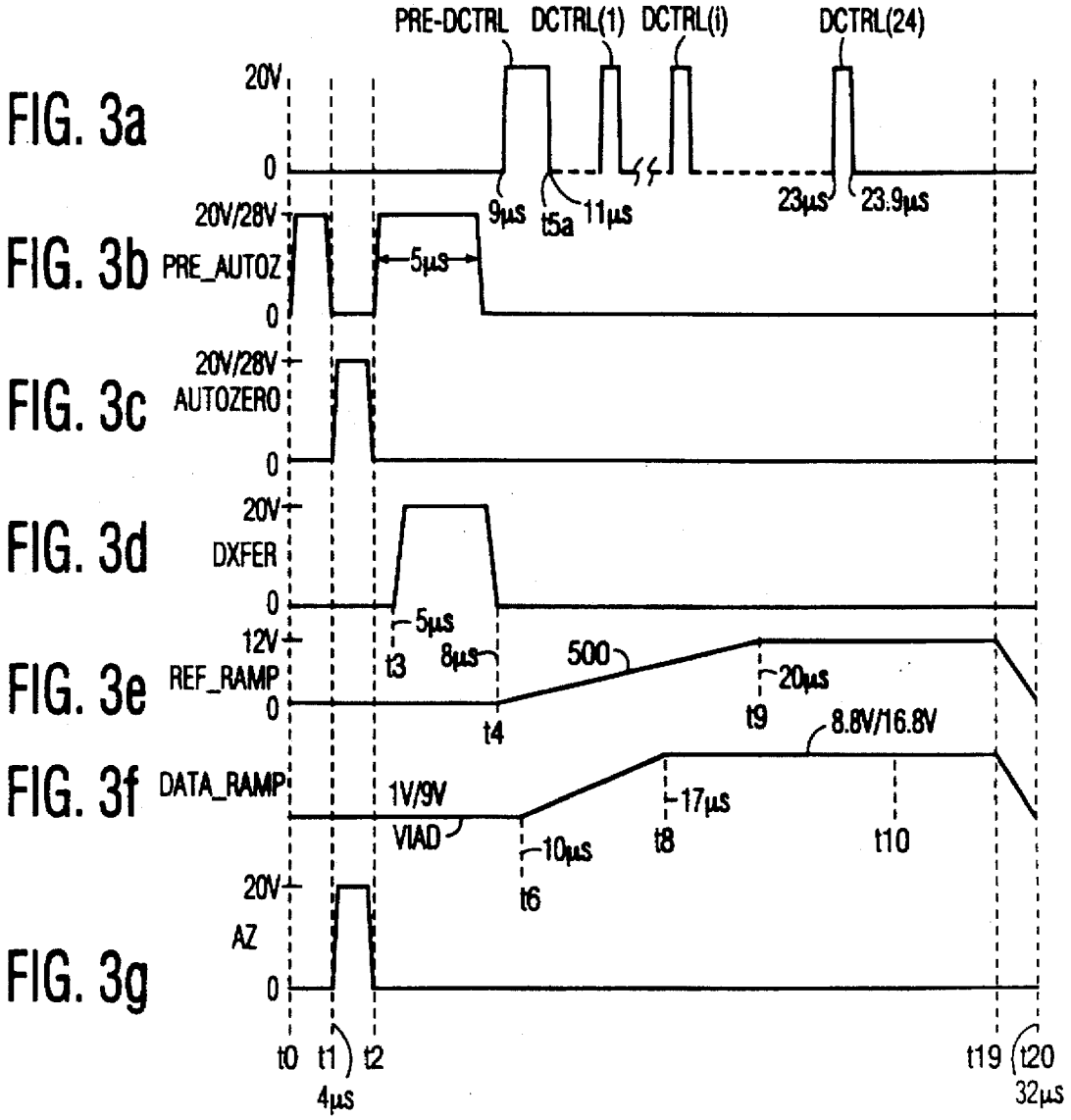
FIGS. 3*a*–3*g* illustrate waveforms useful for explaining the operation of the circuit of FIG. 2.

Prior to sampling the video signal in signal line 31 of FIG. 2, a voltage developed at a terminal D of a capacitor C43 is initialized. To initialize the voltage in capacitor C43, D/A converter 23 develops a predetermined voltage in line 31 such as the maximum, or full scale voltage of video signal IN. A transistor MN1 applies the initializing voltage in line 31 to capacitor C43 when a control pulse PRE-DCTRL of FIG. 3*a* is developed at the gate of transistor MN1. In this way, the voltage in capacitor C43 is the same prior to each pixel updating cycle. Following pulse PRE-DCTRL, signal IN changes to contain video information that is used for the current pixel updating cycle.

Demultiplexer transistor MN1 of a demultiplexer 32 of FIG. 2 samples analog signal IN developed in signal line 31 that contains video information. The sampled signal is stored in sampling capacitor C43 of demultiplexer 32. The sampling of a group of 40 signals IN of FIG. 1 developed in lines 31 occurs simultaneously under the control of a corresponding pulse signal DCTRL(i). As shown in FIG. 3*a*, 24 pulse signals DCTRL(i) occur successively, during an interval following t5*a*–t20. Each pulse signal DCTRL(i) of FIG. 2 controls the demultiplexing operation in a corresponding group of 40 demultiplexers 32. The entire demultiplexing operation of 960 pixels occurs in interval t5*a*–t20 of FIG. 3*a*.

To provide an efficient .time utilization, a two-stage pipeline cycle is used. Signals IN are demultiplexed and stored in 960 capacitors C43 of FIG. 2 during interval t5*a*–t20, as explained before. During an interval t3–t4 of FIG. 3*d*, prior to the occurrence of any of pulse PRE-DCTRL and the 24 pulse signals DCTRL of FIG. 3*a*, each capacitors C43 of FIG. 2 is coupled to a capacitor C2 via a transistor MN7 when a pulse signal DXFER of FIG. 3*d* occurs. Thus, a portion of signal IN that is stored in capacitor C43 is transferred to capacitor C2 of FIG. 2 and develops a voltage VC2. During interval t5*a*–t20, when pulse signals DCTRL of FIG. 3*a* occur, voltage VC2 of FIG. 2 in capacitor C2 is applied to array 16 via corresponding data line 17, as explained below. Thus, signals IN are applied to array 16 via the two-stage pipeline.

A reference ramp generator 33 provides a reference ramp signal REF-RAMP on an output conductor 27. Conductor 27 is coupled, for example, in common to a terminal E of each capacitor C2 of FIG. 2 of each demultiplexer and data line driver 100. A terminal A of capacitor C2 forms an input terminal of a comparator 24. A data ramp generator 34 of FIG. 1 provides a data ramp voltage DATA-RAMP via an output line 28. In demultiplexer and data line driver 100 of FIG. 2, a transistor MN6 applies voltage DATA-RAMP to data line 17 to develop a voltage VCOLUMN. The row to which voltage VCOLUMN is applied is determined in accordance with row select signals developed in row select lines 18. A display device using a shift register for generating select signals such as developed in lines 18 is described in, for example, U.S. Pat. Nos. 4,766,430 and 4,742,346. Transistor MN6 is a TFT having a gate electrode that is coupled to an output terminal C of comparator 24 by a conductor 29. An output voltage VC from the comparator 24 controls the conduction interval of transistor MN6.

In each pixel updating period, prior to applying voltage VC of comparator 24 to transistor MN6 to control the conduction interval of transistor MN6, comparator 24 is automatically calibrated or adjusted. During interval t0–t1 (FIG. 3*b*) transistor MN10 is conditioned to conduct by a signal PRE-AUTOZ causing imposition of a voltage VPRAZ onto the drain electrode of a transistor MN5 and the gate electrode of transistor MN6. This voltage, designated VC, stored on stray capacitances such as, for example, a source-gate capacitance C24, shown in broken lines, of transistor MN6 causes transistor MN6 to conduct. Transistor MN5 is non-conductive when transistor MN10 precharges capacitance C24.

At a time t1 of FIG. 3*b*, pulse signal PRE-AUTOZ terminates and transistor MN10 is turned off. At time t1, a pulse signal AUTOZERO is applied to a gate electrode of a transistor MN3 that is coupled between the gate and drain terminals of transistor MN5 to turn on transistor MN3. Simultaneously, a pulse signal AZ of FIG. 3*g* is applied to a gate electrode of a transistor MN2 to turn on transistor MN2. When transistor MN2 is turned on, a voltage Va is coupled through transistor MN2 to terminal A of a coupling capacitor C1. Transistor MN2 develops a voltage VAA at terminal A at a level of voltage Va for establishing a triggering level of comparator 24 at terminal A. The triggering level of comparator 24 is equal to voltage Va. A second terminal B of capacitor C1 is coupled to transistor MN3 and the gate of transistor MNS.

Conductive transistor MN3 equilabrates the charge at terminal C, between the gate and drain electrodes of transistor MNS, and develops a gate voltage VG on the gate electrode of transistor MN5 at terminal B. Initially, voltage VG exceeds a threshold level VTH of transistor MN5 and causes transistor MN5 to conduct. The conduction of transistor MN5 causes the voltages at each of terminals B and C to decrease until each becomes equal to the threshold level VTH of transistor MN5, during the pulse of signal AUTOZERO. Gate electrode voltage VG of transistor MN5 at terminal B is at its threshold level VTH when voltage VAA at terminal A is equal to voltage Va. At time t2 of FIGS. 3*c* and 3*f*, transistors MN3 and MN2 of FIG. 2 are turned off and comparator 24 is calibrated or adjusted. Therefore, the triggering level of comparator 24 of FIG. 2 with respect to input terminal A is equal to voltage Va.

As explained above, pulse signal DXFER developed, beginning at time t3, at the gate of transistor MN7 couples capacitor C43 of demultiplexer 32 to capacitor C2 via terminal A. Consequently, voltage VC2 that is developed in capacitor C2 is proportional to the level of sampled signal IN in capacitor C43. The magnitude of signal IN is such that voltage VAA developed at terminal A, during pulse signal DXFER, is smaller than triggering level Va of comparator 24. Therefore, comparator transistor MN5 remains non-conductive immediately after time t3. A voltage difference between voltage VAA and the triggering level of comparator 24 that is equal to voltage Va is determined by the magnitude of signal IN.

When voltage VAA at terminal A exceeds voltage Va, transistor MN5 becomes conductive. On the other hand, when voltage VAA at terminal A does not exceed voltage Va, transistor MN5 is nonconductive. The automatic calibration or adjustment of comparator 24 compensates for threshold voltage drift, for example, in transistor MN5.

Pulse signal PRE-AUTOZ, following time t2 of FIG. 3*b*, is coupled to the gate electrode of transistor MN10 of FIG. 1. Transistor MN10 applies voltage VPRAZ to the gate of transistor MN6, to turn on transistor MN6. Because transistor MN5 is nonconductive following time t3 of FIG. 3*d*, the charge that is applied by transistor MN10 remains stored in the inter-electrode capacitance of transistor MN6. Therefore, transistor MN6 remains conductive after transistor MN10 is turned off.

When transistor MN6 is conductive, it establishes a predetermined initial condition of voltage VCOLUMN on line 17 and in pixel cell 16*a* of FIG. 1 of the selected row. Transistor MN6 establishes voltage VCOLUMN at an inactive level VIAD of signal DATA-RAMP, prior to time t6. Thus, capacitance C4 associated with the data line 17 is charged/discharged toward inactive level VIAD of signal DATA-RAMP. Advantageously, establishing the initial condition in pixel cell 16*a* prevents previous stored picture information contained in the capacitance of pixel cell 16*a* from affecting pixel voltage VCOLUMN at the current update period of FIGS. 3*b*–3*g*.

At time t4 of FIG. 3*e*, reference ramp signal REF-RAMP begins up-ramping. Signal REF-RAMP is coupled to terminal E of capacitor C2 of FIG. 2 that is remote from input terminal A of comparator 24. As a result, voltage VAA at input terminal A of comparator 24 is equal to a sum voltage of ramping signal REF-RAMP and voltage VC2 developed in capacitor C2.

In accordance with an inventive feature, during interval t1–t2 of FIG. 3*c*, when the automatic triggering voltage adjustment or calibration of comparator 24 occurs, transistor MN2 couples voltage Va to capacitor C2 via terminal A, that is remote from reference ramp generator 33. Similarly, during interval t3–t4, when the charge is transferred to capacitor C2, transistor MN7 is coupled to capacitor C2 via terminal A that is remote from ramp generator 33. Thus, terminal E of capacitor C2, advantageously, need not be decoupled from conductor 27 of reference ramp generator 33. Because terminal E need not be decoupled from reference ramp generator 33, signal REF-RAMP is coupled to terminal A of comparator 24 without interposing any TFT switch between conductor 27 of reference ramp generator 33 and terminal A. A TFT in the signal path might have suffered from threshold voltage drift. Advantageously, conductor 27 may be common to several units of multiplexer and data drivers 100.

Following time t6, data ramp voltage DATA-RAMP coupled to the drain electrode of transistor MN6 begins upramping. With feedback coupling to terminal C from the stray gate-source and gate driven capacitance of transistor MN6, the voltage at terminal C will be sufficient to condition transistor MN6 to conduct for all values of the data ramp signal DATA-RAMP. Following time t4, and as long as ramping voltage VAA at terminal A has not reached the triggering level that is equal to voltage Va of comparator 24, transistor MN5 remains non-conductive and transistor MN6 remains conductive. As long as transistor MN6 is conductive, upramping voltage DATA-RAMP is coupled through transistor MN6 to column data line 17 for increasing the potential VCOLUMN of data line 17 and, therefore, the potential applied to pixel capacitance CPIXEL of the selected row. The capacitive feedback of ramp voltage VCOLUMN via, for example, capacitance 24, sustains transistor MN6 in conduction, as long as transistor MN5 exhibits a high impedance at terminal C, as indicated before.

At some time during the upramping portion 500 of signal REF-RAMP of FIG. 3*e*, the sum voltage VAA at terminal A will exceed the triggering level Va of comparator 24, and transistor MN5 will become conductive. The instant that transistor MN5 becomes conductive is determined .by the magnitude of signal IN.

When transistor MN5 becomes conductive, gate voltage VC of transistor MN6 decreases and causes transistor MN6 to turn off. As a result, the last value of voltage DATA-RAMP that occurs prior to the turn-off of transistor MN6 is held unchanged or stored in pixel capacitance CPIXEL until the next updating cycle. In this way, the current updating cycle is completed.

In order to prevent polarization of liquid crystal array 16 of FIG. 1, a so-called backplane or common plane of the array, not shown, is maintained at a constant voltage VBACKPLANE. Multiplexer and data line driver 100 produces, in one updating cycle, voltage VCOLUMN that is at one polarity with respect to voltage VBACKPLANE and at the opposite polarity and the same magnitude, in an alternate updating cycle. To attain the alternate polarities, voltage DATA-RAMP is generated in the range of 1V–8.8V in one updating cycle and in the range of 9V–16.8V in the alternate update cycle. Whereas, voltage VBACKPLANE is established at an intermediate level between the two ranges. Because of the need to generate voltage DATA-RAMP in two different voltage ranges, signals or voltages AUTOZERO, PRE-AUTOZ and Vss have two different peak levels that change in alternate updating cycles in accordance with the established range of voltage DATA-RAMP.

What is claimed is:

1. Apparatus for applying video signal to a plurality of column electrodes of a display device, comprising:

a source of a video signal;

a reference ramp generator for generating a reference ramp signal;

a plurality of data line drivers, a given data line driver that is associated with a corresponding column electrode being responsive to said video signal for applying said video signal to said column electrode, said given data line driver including:

a comparator;

a capacitance for coupling said reference ramp generator to an input of said comparator;

a first switching arrangement coupled to said video signal source and to said capacitance for selectively storing said video signal in said capacitance to apply said stored video signal to said input of said comparator, such that, when said video signal is being stored in said capacitance, an output terminal of said reference ramp generator is connected in common to respective electrodes of the capacitances of each of said data line drivers in a manner to exclude any switching element between said ramp generator output terminal and each of the capacitances;

a source of a data ramp signal; and a switching transistor responsive to an output signal of said comparator for applying said data ramp signal to said column electrode during a controllable portion of a period of said data ramp signal that varies in accordance with a signal that is developed at said input of said comparator.

2. An apparatus according to claim 1, wherein said comparator comprises a second capacitance and a second switching arrangement coupled to said second capacitance and to a source of an adjustment signal for generating a voltage in said second capacitance that automatically adjusts a triggering level of said comparator in accordance with said adjustment signal.

3. An apparatus according to claim 2 wherein said adjustment signal is coupled to an interconnection of said second and first capacitances.

4. An apparatus according to claim 2 wherein said first capacitance is coupled between said reference ramp generator and said second switching arrangement.

5. An apparatus according to claim 2 wherein said comparator comprises a second transistor coupled to a control terminal of said first switching transistor and wherein a third transistor is coupled between a control terminal of said second transistor and a main current conducting terminal of said second transistor for adjusting said triggering level of said comparator in accordance with said adjustment signal.

6. An apparatus according to claim 1 wherein said comparator comprises a second transistor and a second capacitance coupled between said first capacitance and a control terminal of said second transistor and wherein said first switching arrangement is coupled to a junction terminal between said capacitances.

7. An apparatus according to claim 1 wherein said output terminal of said reference ramp generator is coupled to said input of said comparator via a signal path that excludes any switching arrangement.

8. A comparator for a data line driver of a display device, comprising:

a first transistor;

a first capacitance coupled to a control terminal of said first transistor to form a comparator;

a first switching arrangement coupled to said first capacitance for storing a charge in said first capacitance that automatically compensates for variations in a triggering level of said first transistor;

a reference ramp generator for generating a reference ramp signal;

a second capacitance coupled to said reference ramp generator and to said first capacitance for capacitively coupling said reference ramp signal to said control terminal via each of said first and second capacitances;

a source of a video signal; and a second switching arrangement coupled to said second capacitance for storing said video signal in said second capacitance.

9. A comparator according to claim 8 further comprising, a second transistor coupled between a main current conducting terminal of said first transistor and a control terminal of said first transistor and wherein said second transistor and said first switching arrangement are coupled to different terminals of said first capacitance to develop a voltage in said first capacitance that automatically adjusts said triggering level of said comparator.

10. A comparator according to claim 8 wherein said second capacitance is coupled between said reference ramp generator and said first capacitance.

11. A video apparatus for developing a signal containing picture information in pixels of a display device that are arranged in columns, comprising:

a reference ramp generator for generating a reference ramp signal;

a plurality of data line drivers responsive to said video signal for applying said video signal to said pixels, a given data line driver of said plurality of line drivers being coupled to pixels arranged in a corresponding column that is associated with said given data line driver, said given data line driver including:

a first transistor;

a capacitance for capacitively coupling said reference ramp generator to an input of said first transistor;

a source of a video signal;

a first switching arrangement responsive to said video signal and coupled to said capacitance via a terminal of said capacitance that is remote from said reference ramp generator relative to a second terminal of said capacitance for storing said video signal in said capacitance;

a source of a data ramp signal;

a switching transistor responsive to an output signal developed at an output of said first transistor for applying said data ramp signal to said pixels of said column that is associated with said given data line driver, during a controllable portion of a period of said data ramp signal that varies in accordance with said video signal.

12. Apparatus for applying video signal to a column electrode of a display device, comprising:

a source of a video signal;

a reference ramp generator for generating a reference ramp signal;

a data line driver responsive to said video signal for applying said video signal to said column electrode, said data line driver including:

a first transistor;

a capacitance having a first terminal coupled to said reference ramp generator and a second terminal coupled to a control terminal of said transistor;

a first switching arrangement coupled to said video signal source and to said capacitance via said second terminal of said capacitance for selectively applying said video signal to said capacitance;

a source of a data ramp signal; and a switching transistor responsive to an output signal developed at an output terminal of said first transistor for applying said data ramp signal to said column electrode during a controllable portion of a period of said data ramp signal that varies in accordance with a signal that is developed at said control terminal of said first transistor.

* * * * *